US005522342A

United States Patent [19]

Chen-Chao

[11] Patent Number: 5,522,342

[45] Date of Patent: Jun. 4, 1996

[54] APPARATUS FOR PREVENTING FLAGS AND BANNERS FROM FOLDING

[76] Inventor: Huang Chen-Chao, No. 20, Lane 124, Sec. 5, Hsin Hai Rd., Taipei, Taiwan

[21] Appl. No.: 313,875

[22] Filed: Sep. 28, 1994

[51] Int. Cl.[6] ..... G09F 17/00

[52] U.S. Cl. ..... 116/174

[58] Field of Search ..... 116/173, 174, 116/175; 40/218, 602

[56] References Cited

U.S. PATENT DOCUMENTS

| | | | |
|---|---|---|---|
| 433,124 | 7/1890 | Hall | 116/174 |
| 2,672,118 | 3/1954 | Martin | 116/174 |
| 2,799,240 | 7/1957 | Andrews | 116/174 |
| 3,158,132 | 11/1964 | Guthrie | 116/173 |
| 3,183,886 | 5/1965 | Moffitti, Jr. | 116/173 |
| 4,864,962 | 9/1989 | Kuehl et al. | 116/174 |
| 5,005,512 | 4/1991 | Fu | 116/173 |

FOREIGN PATENT DOCUMENTS

| | | | |
|---|---|---|---|
| 63529 | 1/1892 | Germany | 116/174 |
| 56121 | 2/1924 | Sweden | 116/174 |
| 58669 | 4/1925 | Sweden | 116/173 |

*Primary Examiner*—William A. Cuchlinski, Jr.
*Assistant Examiner*—Willie Morris Worth
*Attorney, Agent, or Firm*—Morton J. Rosenberg; David I. Klein

[57] ABSTRACT

An apparatus for preventing flag banners from folding is provided. The apparatus comprises a flag pole having an upper portion with an annular recess formed therein, a lower base with an annular recess and two connecting buttons rotatably coupled within the respective annular recesses. The flag banner is connected to the flag pole by two button holes engaged by the two connecting buttons. The connecting buttons rotate within the annular recesses so that when the wind blows in a different direction, the flag banner can change direction accordingly, without wrapping the flag around the pole.

1 Claim, 3 Drawing Sheets

APPARATUS FOR PREVENTING FLAGS AND BANNERS FROM FOLDING

BACKGROUND OF THE INVENTION

FIELD OF THE INVENTION

The present invention relates to an apparatus for preventing flags and banners from folding. In particular, the present invention allows a banner to rotate according to the wind direction, so as not to cause the banner to wrap around the flag pole.

PRIOR ART

In the past, all kinds of banners were tied fixedly to flag poles. Each such banner flies on its flag pole according to the wind direction. Although the method of tying such banners may be different, the shortcoming is the same. That is to say, when the wind changes direction, the banner changes the direction it flies according to the current wind direction. But, part of said banner folds around the flag pole when the banner changes the direction it flies when the wind changes direction. The functionality of the banner decreases because people cannot see clearly the content of the banner when it wraps around the flag pole. It is necessary to solve this problem which now requires unfolding the banner on the flag pole by manual means, especially the banners secured to car mounted flag poles.

OBJECTS OF THE INVENTION

It is the object of this invention to provide an apparatus to prevent banners from folding on flag poles. This apparatus comprises two rotating buttons for fixing the banner on the flag pole by respective button holes. When the wind changes direction, the banner can change direction according to the wind direction without wrapping the banner around the flag pole.

Another object of this invention is to provide such an apparatus having a low production cost.

SUMMARY OF THE INVENTION

An apparatus for preventing flags and banners from folding, comprises two rotating buttons and a set of bases secured on an upper portion of a flag pole. The flag banner is connected to the flag pole by the pair of rotating buttons. When the wind blows in a certain direction, the flag banner changes direction according to the wind direction, by means of the rotating buttons without wrapping the banner around the flag pole.

DESCRIPTION OF THE PREFERRED EMBODIMENT

Figure 1:
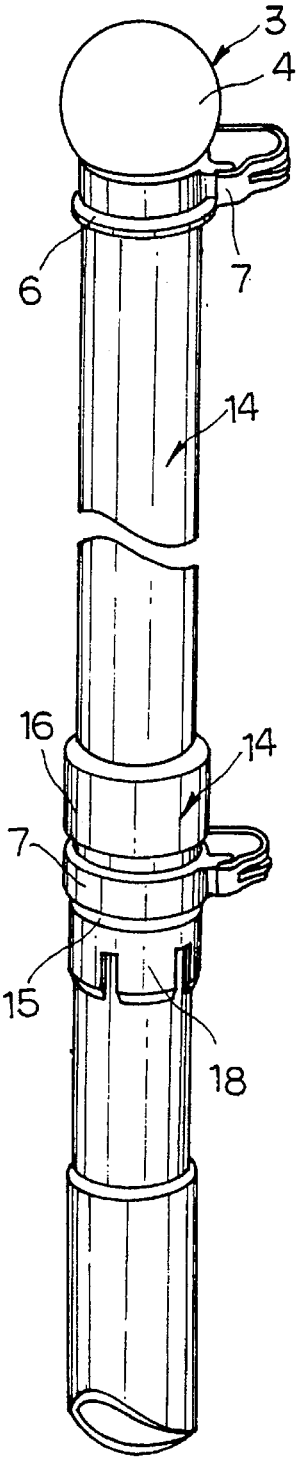
FIG. 1 is a perspective view of a preferred embodiment of the invention.
Figure 2:
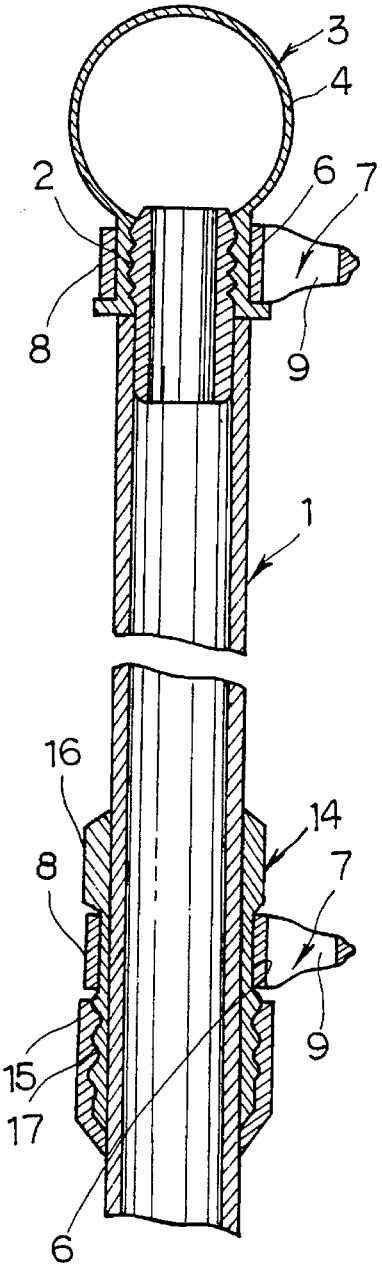
FIG. 2 is a cross-sectional view showing a flag pole, the top of the flag pole, a connecting base, a connecting button and the relationship between them.
Figure 3:
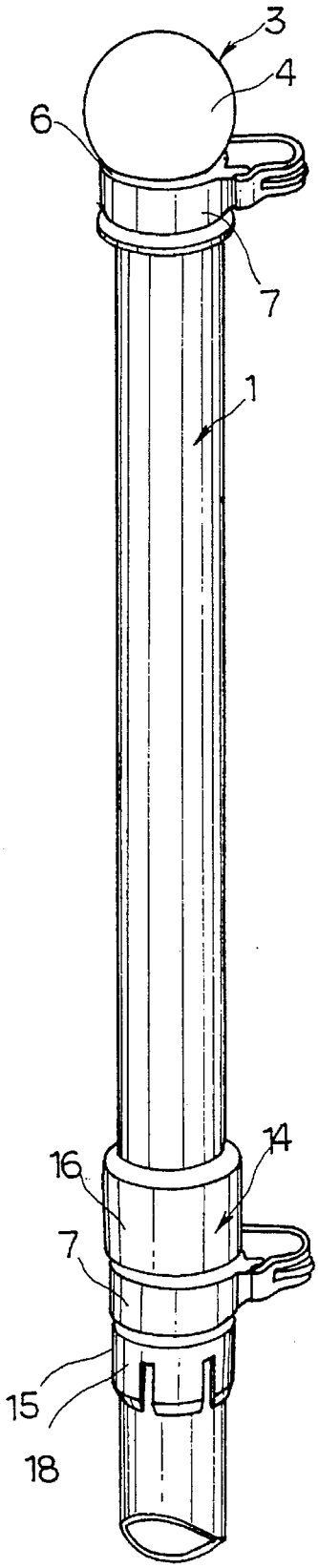
FIG. 3 is a perspective view of the apparatus when the flag pole is a conventional fixed flag pole.
Figure 5:
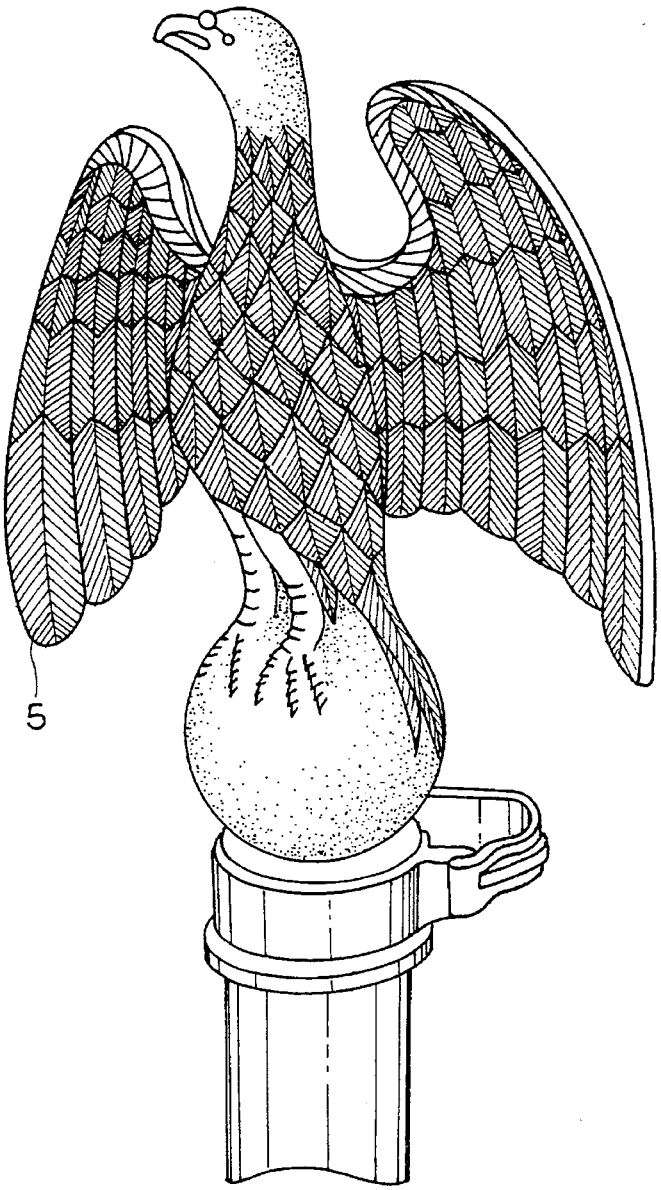
FIG. 5 is a perspective view showing the top of the flag pole with an eagle decoration.
Figure 6:
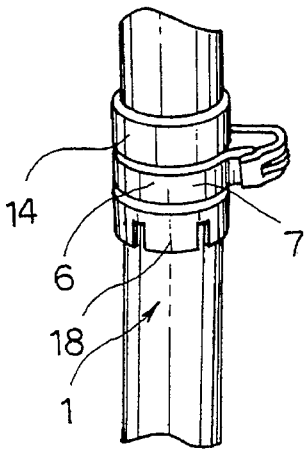
FIG. 6 is a perspective view of the structure of a preferred embodiment of the connecting base; and, FIG. 7 is a perspective view showing the apparatus of this invention in use.

As shown in FIGS. 1 and 2, the flag pole of this invention can be a telescoping type flag pole I or a conventional fixed length flag pole 1 (as shown in FIG. 3). The top portion 3 of the flag pole 1 has a connecting button 7 disposed thereon. The top portion 3 of the flag pole may have a conventional round ball 4 or some decoration 5, as shown in FIG. 5. Under the ball 4 or decoration 5, the top portion 3 of the flag pole is provided with an annular recess 6 in which a connecting button 7 can rotate.

Figure 4:
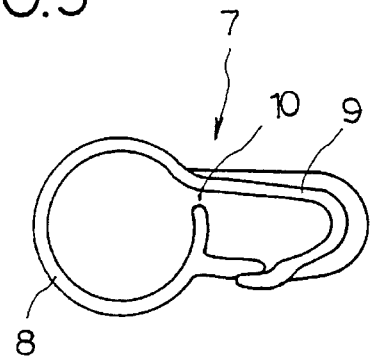
FIG. 4 is a plan view of the connecting button, showing the shape and the structure of the connecting button.

Referring to FIGS. 2 and 4, the connecting button 7 has a large open round circular portion 8, its diameter being larger than the diameter of the annular recess 6, so that the connecting button can freely rotate in the annular recess 6. The circular portion 8 has an open section 10, so that it can expand and be coupled to the top portion within the annular recess 6. The connecting button also has a small circular portion 9 having an openable section for lockingly engaging the flag banner 11 by an upper banner hole 12, as shown in FIG. 7.

As FIGS. 1 and 2 show, the other connecting button 7 is connected to flag pole 1 by a base 14:. The base 14 comprises one upper connecting base 16 and one lower connecting base 15. The upper connecting base 16 has an annular recess 6 and external threads 17 for connection with a clamp 18 of lower connecting base 15 to thereby clamp the base 14 on the flag pole 1.

Figure 7:
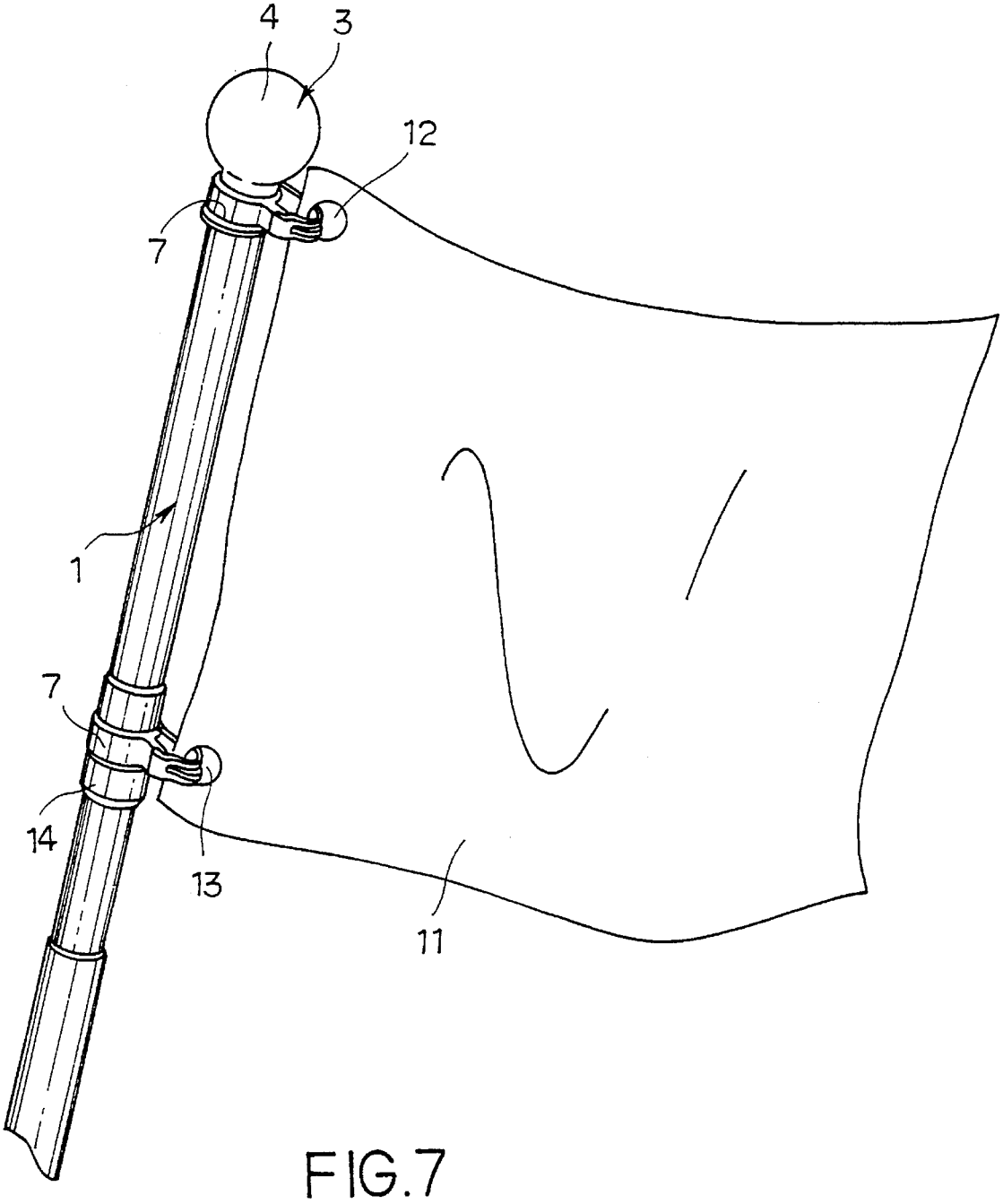

As shown in FIG. 7, the flag banner 11 has an upper button hole 12 and a lower button hole 13. The flag banner can be connected by the upper button hole 12 and the lower button hole 13 on the respective connecting buttons 7. As the wind blows in one direction, connecting buttons can rotate in the same direction so that the flag banner 11 will not be wrapped around the flag pole 1.

I claim:

1. A rotatably coupled flag and flag pole combination apparatus, comprising:

a longitudinally extended flag pole;

a flag pole top member secured to an upper end of said flag pole, said flag pole top member having a first annular recess formed therein;

a connecting base concentrically disposed on said flag pole and clampingly secured thereto in longitudinally spaced relationship with said flag pole top member, said connecting base including (1) an upper connecting base member having a second annular recess formed therein and threads formed on an external surface of one end thereof, and (2) a lower connecting base member having internal threads formed in one end thereof for coupling with said externally threaded end of said upper connecting base member, said threaded coupling of said upper connecting base member to said lower connecting base member providing a clamping engagement of said connecting base to said flag pole; and, a pair of connecting buttons rotatably secured to said flag pole within a respective one of said first and second annular recesses, each of said pair of connecting buttons having a first circular portion concentrically disposed within a respective one of said first and second recesses, said first circular portion having a diameter greater than a diameter of a respective one of said first and second recesses for free rotation therein, each of said pair of connecting buttons having a second circular portion for coupling to a respective aperture formed in one edge of a flag, whereby the flag can rotate with said pair of connecting buttons responsive to changes in wind direction without being wrapped around said flag pole.

* * * * *